US006038763A

United States Patent [19]

Kodera et al.

[11] Patent Number: 6,038,763

[45] Date of Patent: Mar. 21, 2000

[54] PROCESSED WIRE CONNECTING APPARATUS

[75] Inventors: Hiroji Kodera, Gifu; Yoji Katsuno, Kakamigahara, both of Japan

[73] Assignee: Kodera Electronics Co.,. Ltd., Gifu-ken, Japan

[21] Appl. No.: 08/953,107

[22] Filed: Oct. 17, 1997

Related U.S. Application Data

[63] Continuation of application No. 08/586,736, Jan. 30, 1996, abandoned.

[30] Foreign Application Priority Data

Jul. 10, 1995 [WO] WIPO ..... PCT/JP95/01370

[51] Int. Cl.[7] ..... H01R 9/00

[52] U.S. Cl. ..... 29/845; 29/747; 29/743; 29/759

[58] Field of Search ..... 29/747, 748, 759, 29/845, 564.6, 566.2; 294/100, 115

[56] References Cited

U.S. PATENT DOCUMENTS

| | | | |
|---|---|---|---|
| 4,589,817 | 5/1986 | Adinolfi et al. . | |
| 4,779,334 | 10/1988 | Boutcher, Jr. . | |
| 4,825,537 | 5/1989 | Berry et al. | 29/747 |
| 4,835,844 | 6/1989 | Gerst et al. | 29/747 |
| 4,970,777 | 11/1990 | Folk et al. | 29/748 |
| 5,109,602 | 5/1992 | Fukuda et al. | 29/845 |
| 5,127,159 | 7/1992 | Kudo et al. . | |
| 5,414,925 | 5/1995 | Nishide et al. | 29/748 |
| 5,477,607 | 12/1995 | Ohta et al. | 29/33 M X |

FOREIGN PATENT DOCUMENTS

| | | | |
|---|---|---|---|
| 0 223 330 | 7/1986 | European Pat. Off. | H01R 43/01 |
| 534 822 | 3/1993 | European Pat. Off. | 29/738 |
| 51-90495 | 8/1976 | Japan | H01R 43/00 |
| 55-163899 | 12/1980 | Japan | H05K 13/00 |
| 56-103025 | 8/1981 | Japan | B65G 47/91 |
| 57-185477 U | 11/1982 | Japan | B23K 9/14 |
| 60-130078 | 7/1985 | Japan | H01R 43/26 |
| 62-113375 | 5/1987 | Japan | H01R 43/00 |
| 63-138680 | 6/1988 | Japan | H01R 43/00 |
| 63-152891 | 6/1988 | Japan | H01R 43/00 |
| 2-500940 | 3/1990 | Japan | H01R 43/052 |
| 5-234659 | 9/1993 | Japan | H01R 43/20 |
| 5-242947 | 9/1993 | Japan | H01R 43/20 |
| 6-33387 | 4/1994 | Japan | H01R 43/052 |
| 7-153545 | 6/1995 | Japan | H01R 43/20 |
| 9-70785 | 3/1997 | Japan | B25J 15/08 |
| WO 88/03722 | 5/1988 | WIPO | H01R 43/052 |

OTHER PUBLICATIONS

Communication from the EPO dated Jan. 15, 1998 enclosing Supplementary European Search Report for Application No. EP 95 92 4530.

Brochure "Castugnon" believed published Oct. 1, 1994.

*Primary Examiner*—Lee Young
*Assistant Examiner*—Bobby Rushing, Jr.
*Attorney, Agent, or Firm*—Limbach & Limbach, LLP

[57] ABSTRACT

An apparatus for automatically connecting prepared wires to a connector (plug or socket) is described. The prepared wires have a terminal on at least one end. A connector holder is provided for holding the connector in position. A chuck is provided for taking a prepared wire from a storage case. The wire is transferred to a rotator for correcting the rotational angle of the wire and its associated terminal. The wire is gripped by another chuck, which inserts it into the connector.

22 Claims, 10 Drawing Sheets

PROCESSED WIRE CONNECTING APPARATUS

This is a continuation of application Ser. No. 08/586,736, filed Jan. 30, 1996, abandoned.

BACKGROUND OF THE INVENTION

1. Field of the Invention

The present invention relates to a processed wire connecting apparatus that automatically inserts cut processed wires into connecting holes provided on connectors, and more particularly, to a wire connecting apparatus that automatically orients a wire prior to its connection.

2. Description of the Related Art

In the prior art, plug connectors and a socket connector are used to electrically connect groups of of corresponding wires to each other. A plurality of connecting holes are formed in the socket connector and the plug connector in their respective non-mating ends. A connecting terminal, which is attached to each wire, is inserted into each connecting hole. The insertion of the terminals into the connecting holes is carried out manually.

The corresponding terminals of the plug connector wires and the socket connecter wires are connected to each other when the plug connector is coupled to the socket connector. Each wire is colored differently on both connectors. The corresponding wires, which are to be connected to each other, have the same color. By using the plug connector and the socket connector to connect wires, a plurality of corresponding wires may simultaneously be connected to corresponding wires. In addition, it is possible to prevent wrong connections by coupling the two connectors with the color of corresponding wires matched to each other.

However, the connecting operation in which the wires are connected to the two connectors is burdensome since the terminals are manually inserted into the connecting holes. Therefore, a wire connecting apparatus that automatically inserts the wire terminals into the connecting holes of the connector has been proposed. The wire connecting apparatus is provided with a plurality of wire feeders, a wire processor, a wire conveyor, and a connector holder.

SUMMARY OF THE INVENTION

Basically, the invention is an apparatus for automatically connecting processed wires to a connector body. The connector body, such as a plug or socket, has holes for receiving wires. The apparatus includes a wire gripping device for lifting a processed wire, which is cut to a predetermined length, from a pile of such wires. Further included is a wire inserter for inserting the lifted wire into one of the holes on the connector body by moving the lifted wire relative to the connector body.

In the preferred and illustrated embodiment, a position corrector is provided for orienting wires prior to insertion.

The invention further includes a method for automatically connecting processed wires to a connector body. The connector body has holes for receiving wires, the method includes actuating a wire gripping device for lifting a processed wire, which is cut to a predetermined length, from a pile of such wires, and actuating a wire inserter for inserting the lifted wire into one of the holes on the connector body by moving the lifted wire relative to the connector body.

In the preferred method, the wires are automatically oriented prior to insertion in the connector body.

By using the above wire attaching apparatus, the connecting operation is facilitated since the terminals of the differently colored wires are automatically inserted in the connecting holes of the connector.

However, the structure of the above wire connecting apparatus is complicated. This is due to the necessity to provide a plurality of wire feeders in which the number of the feeders depends on the number of wire colors, and the necessity to provide a mechanism to slide each wire feeder.

It is a primary objective of the present invention to provide a processed wire connecting apparatus with a simplified structure.

DISCLOSURE OF THE INVENTION

A processed wire connector apparatus according to the present invention is provided with a wire lifting means. The lifting means lifts a processed wire which is cut into a predetermined length and kept in a stored state. The processed wire is inserted into a connecting hole of a wire connecting body after being lifted by a wire connecting means. Therefore, since it is not necessary to store wires in a wound state, the structure of the connecting apparatus is simplified and an automated connecting operation which does not require man power can be performed.

BRIEF DESCRIPTION OF THE DRAWINGS

FIG. 10(*b*) is a front view showing a main manipulating plate and main gripping plates;

FIG. 11(*b*) is a front view showing a main manipulating plate and main gripping plates;

FIG. 12(*b*) is a front view showing a main manipulating plate and main gripping plates.

DETAILED DESCRIPTION OF THE PREFERRED EMBODIMENT

An embodiment of the present invention will be described with reference to FIGS. 1–12.

Figure 1:
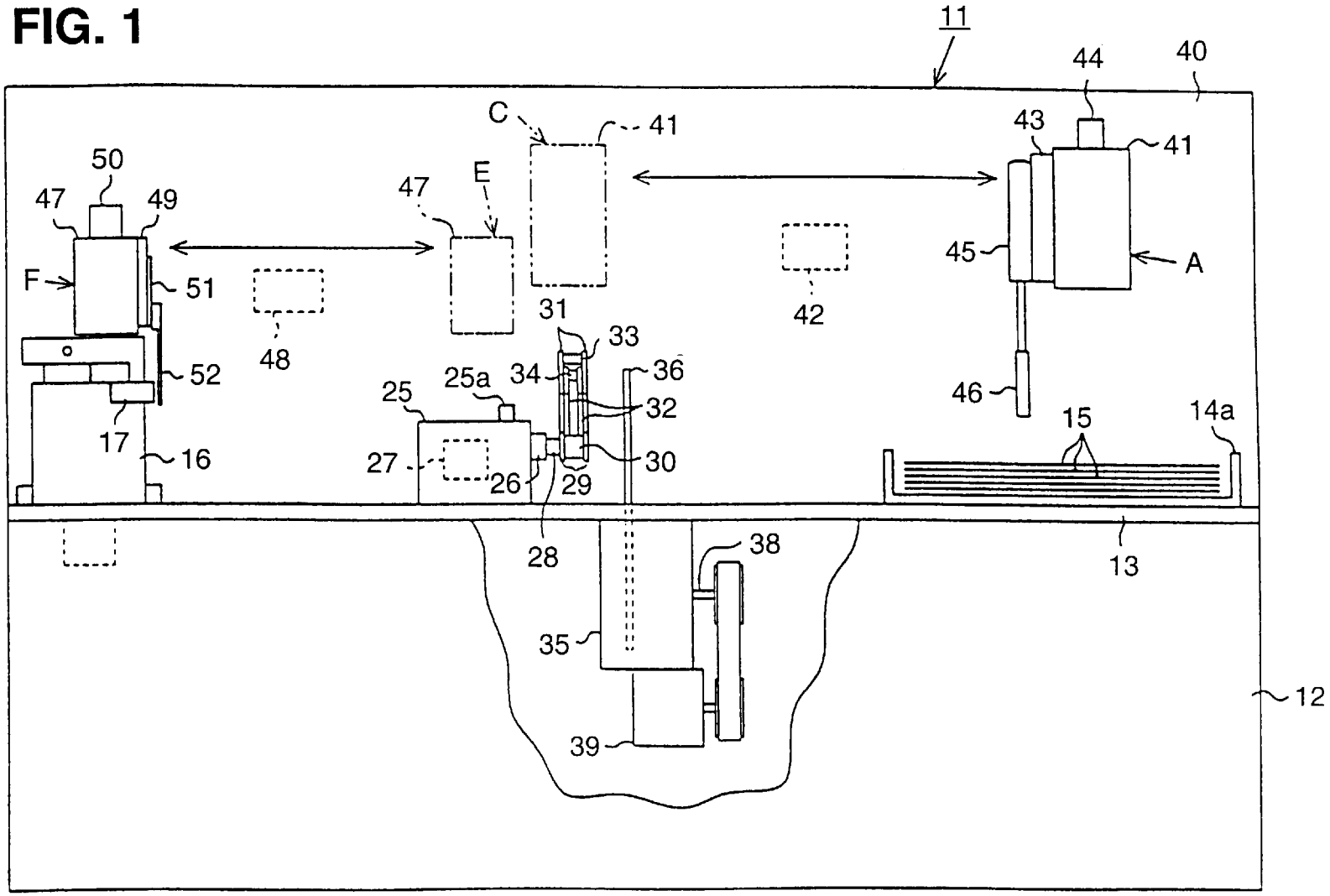
FIG. 1 is a front view showing a processed wire connecting apparatus of the present embodiment.
Figure 2:
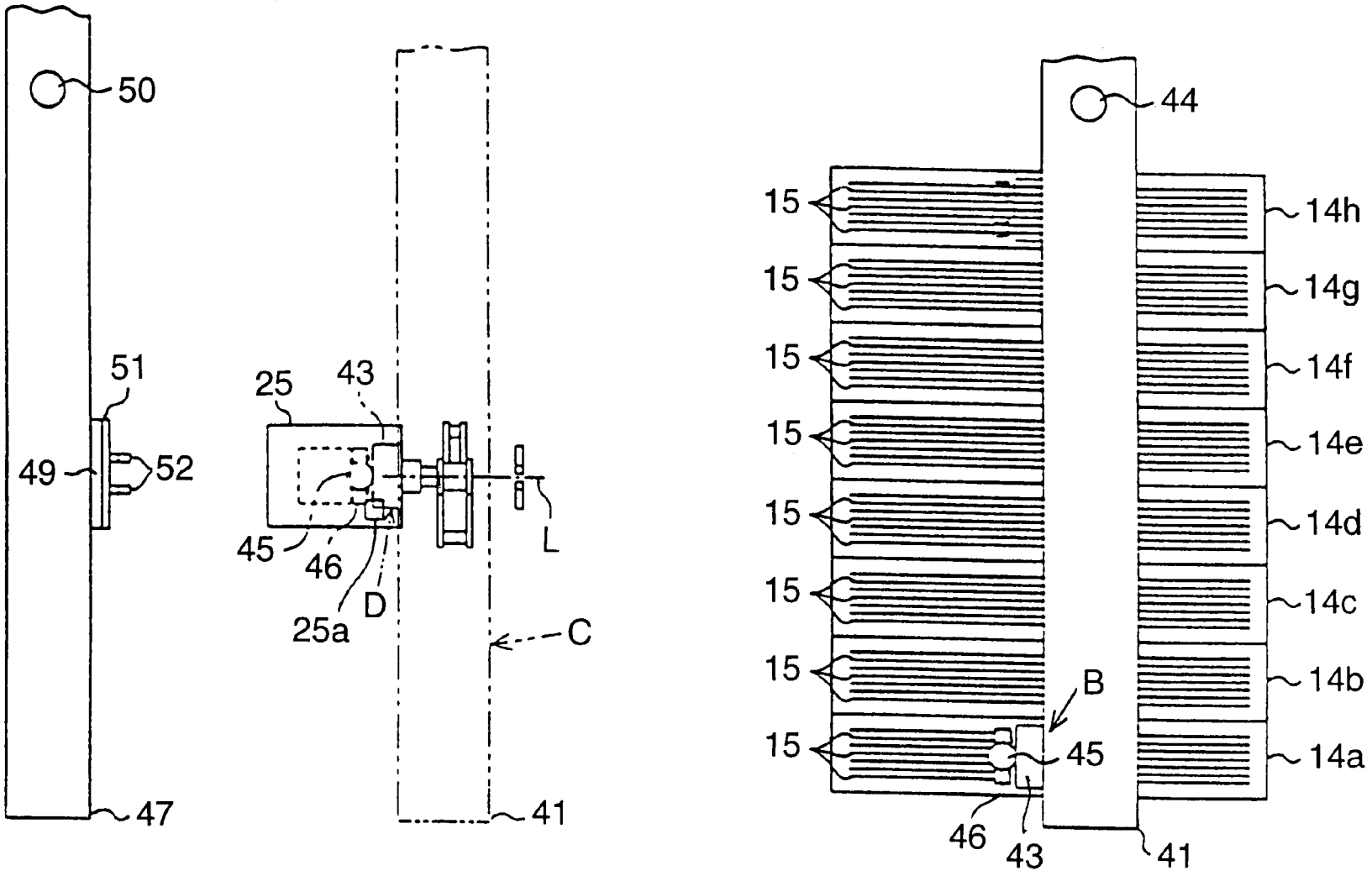
FIG. 2 is a partial plan view showing the connecting apparatus for processed wires.

As shown in FIG. 1, a processed wire connecting apparatus 11 for processed wires has a box-shaped base 12. A task plate 13 extending horizontally is provided on the base 12. A storage case 14*a* is provided on the upper surface of the task plate 13 at the right side of FIG. 1. As shown in FIG. 2, storage cases 14*b*–14*h* are provided adjacent to and parallel with the storage case 14*a*. Each storage case 14*a*–14*h* accommodates a different color of processed wires 15, which are stored in a piled state. The processed wires 15 are formed by cutting wires into certain lengths such as 20 cm.

Figure 3:
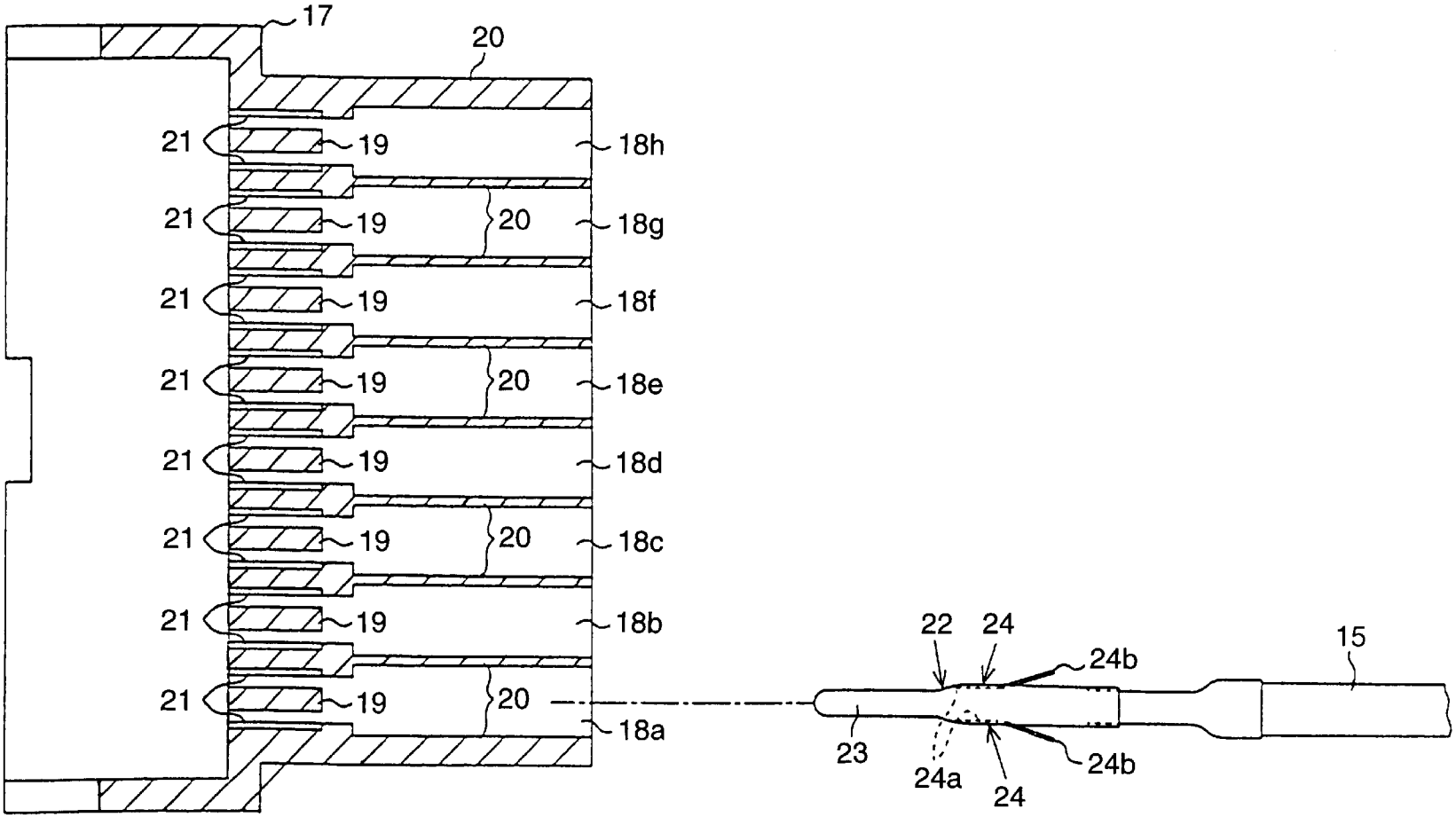
FIG. 3 is a sectional plan view showing a plug connector and a terminal.

As shown in FIG. 1, a connector holder 16 is provided on the upper surface of the task plate 13 and shown at the left side of the drawing. A plug connector 17, which serves as a connector body, is secured to the connector holder 16. As shown in FIG. 3, a plurality of connecting holes 18*a*–18*h* extending horizontally are formed parallel to one another in the plug connector 17. A projection 19 is formed on the inner bottom surface of each connecting hole 18*a*–18*h*. A securing groove 21 is formed on side walls 20, which define each connecting hole 18*a*–18*h*, at both sides of the projection 19.

The processed wires 15 may be inserted into and connected to each connecting hole 18*a*–18*h*. A connecting terminal 22 is attached to an end of each wire 15. A rod-shaped connecting portion 23 is provided at the distal end of the terminal 22. A pair of fastening plates 24 are provided at the proximal end of the terminal 22. The two fastening plates 24 project toward the opposite side of the drawing of FIG. 3 along a direction perpendicular to the plane of the drawing. Thus, the terminal 22 is U-shaped by the two fastening plates 24. At the proximal ends of the fastening plates 24, parallel portions 24*a*, having a predetermined space defined between each other, extend parallel to the direction of the connecting portion 23. A fastening portion 24*b* is bent to project outward of the terminal 22 at the processed wire 15 side of each fastening plate 24. The fastening portion 24*b* is elastic.

By inserting the terminal 22 into the connecting holes 18*a*–18*h*, the projection 19 inside the connecting holes 18*a*–18*h* fits between the parallel portions 24*a*. Furthermore, the fastening portions 24*b* of the fastening plate 24 are urged toward the side walls 20 by their own elasticity and engage the securing grooves 21 of the side walls 20. By engaging the fastening portions 24*b* of the two fastening plates 24 to the securing grooves 21, the processed wire 15 is connected to the plug connector 17.

As shown in FIG. 1, a centering device 25 is provided between the storage cases 14*a*–14*h* and the connector holder 16 on the upper surface of the task plate 13. A rotated angle detecting sensor 25*a* is provided on the upper surface of the centering device 25. A moving member 26, which is movable along the horizontal direction of the centering device 25, is provided at the side of the centering device 25. An electric advancing motor 27 is provided in the centering device 25. When the electric advancing motor 27 is driven, the moving member 26 is extended or retracted horizontally with respect to the centering device 25.

Figure 4:
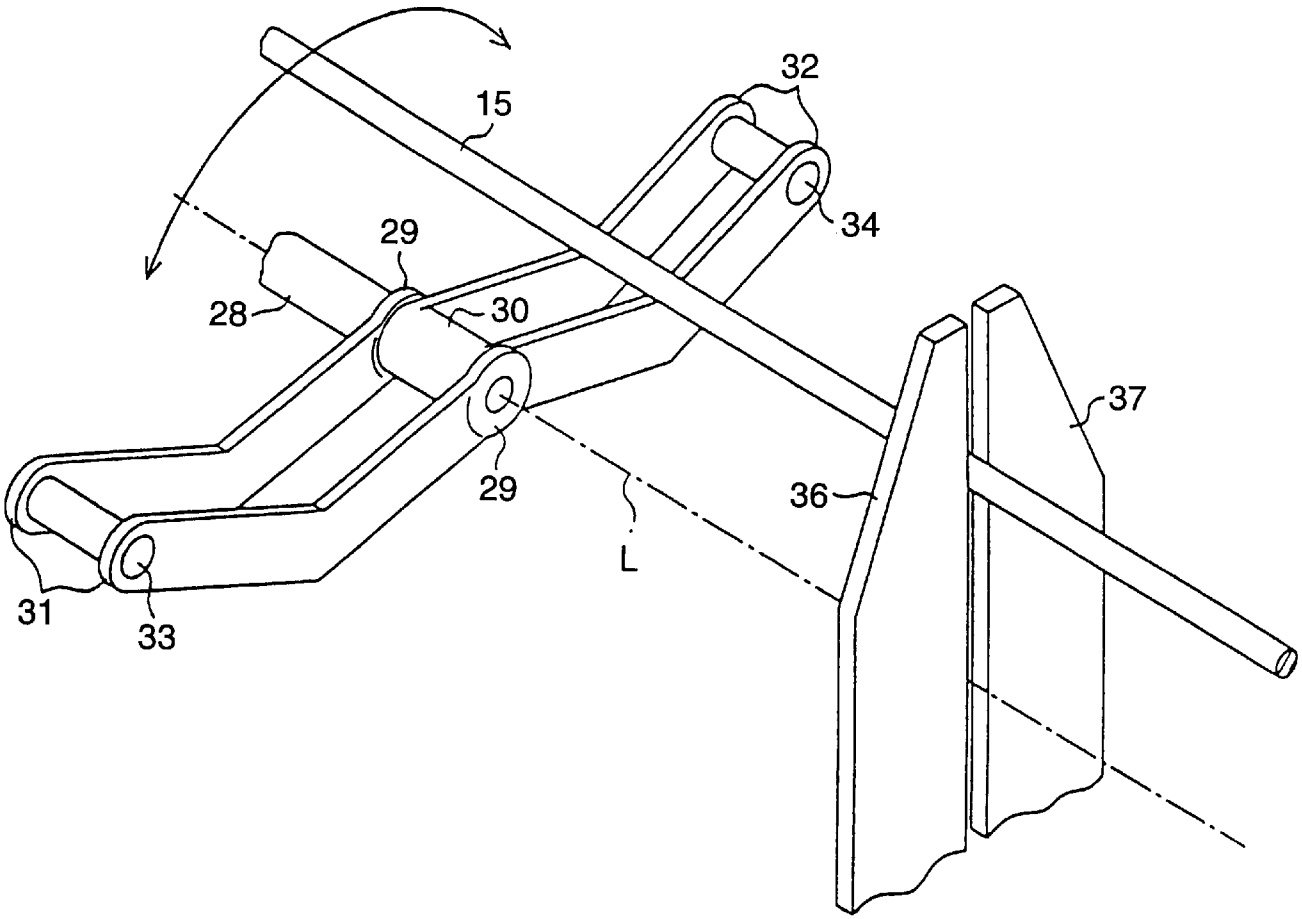
FIG. 4 is a perspective partial view showing clamping pieces and clamping plates.

A horizontal support shaft 28 is provided in the moving member 26. As shown in FIG. 4, a pair of rings 29 and a cylinder 30, arranged between the two rings 29, are fitted on the distal end of the support shaft 28. The two rings 29 and the cylinder 30 are independently pivotal about the support shaft 28. Clamping pieces 31, 32 project in opposite directions from both ends of the cylinder 30 and the two rings 29, respectively. The distal end portion of the clamping pieces 31, 32 are linked by pins 33, 34. The clamping pieces 31, 32 are opened and closed in the direction of the arrow of FIG. 4 by pivoting the clamping pieces 31, 32 toward or away from each other about the support shaft 28. The clamping pieces 31, 32 are bent outward at their longitudinally middle portions.

Figure 5:
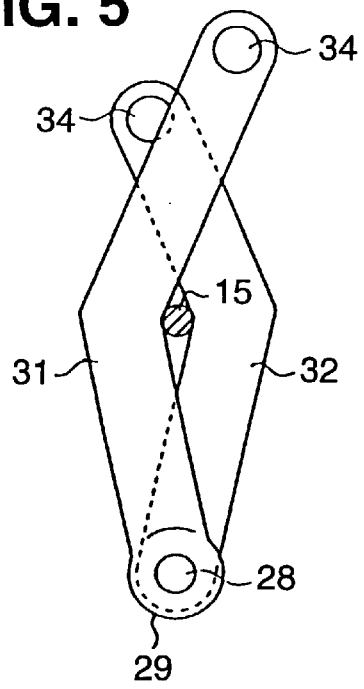
FIG. 5 is a front view showing the clamping pieces.

By arranging a processed wire 15 between the clamping pieces 31, 32 and then closing the clamping pieces 31, 32, the processed wire 15 is held between the longitudinally middle portions of the clamping pieces 31, 32, as shown in FIG. 5. In this state, the processed wire 15 is positioned at the same height and held extending along the same direction as one of the axes of the connecting holes 18*a*–18*h* of the plug connector 17, which is securely held by the connector holder 16. In other words, the support shaft 28 of the centering device 25 is positioned such that the processed wire 15 is positioned at the same height and held extending along the same direction as one of the connecting holes 18*a*–18*h* when the processed wire 15 is held between the clamping pieces 31, 32.

As shown in FIG. 1, a rotated angle correcting device 35 is provided between the centering device 25 and the storage cases 14*a*–14*h* at the lower surface of the task plate 13 inside the base 12. The rotated angle correcting device 35 has a pair of clamping plates 36, 37, (FIG. 1 shows only the clamping plate 36) which are movable in the vertical direction. As shown in FIG. 4, the clamping plates 36, 37 are on opposite sides of the axis L of the support shaft 28 and extend vertically parallel to each other. The distance between the clamping plates 36, 37 is substantially equal to the diameter of the processed wire 15. As shown in FIG. 1, a drive shaft 38 is provided in the rotated angle correcting device 35. The shaft 38 is connected to an electric rotating motor 39. When the electric rotating motor 39 is driven, the clamping plates 36, 37 move vertically in opposite directions.

A vertical support 40 is provided on the upper side of the base 12. A first head 41, which extends along a direction perpendicular to the plane of FIG. 1, is supported by the vertical support 40 and shown at the right side of the drawing. A first electric moving motor 42 is provided on the vertical support 40. When the first electric moving motor 42 is driven, the first head 41 moves between positions above the storage cases 18*a*–18*h* and the centering device 25 as indicated by an arrow in FIG. 1. A first slider 43, movable along the longitudinal direction of the first head 41, is provided on the side wall of the first head 41. A first electric slide motor 44 is provided in the first head 41. When the first electric slide motor 44 is driven, the first slider 43 moves along the first head 41. A cylinder 45, which is extendible in the vertical direction, is provided on the first slider 43. A first hand chuck 46 is mounted on the lower end of the cylinder 45. The cylinder 45 and the first hand chuck 46 serve as a wire lifter. The first hand chuck 46 is moved vertically when the cylinder is extended and retracted.

A second head 47, which extends along a direction perpendicular to the plane of FIG. 1, and is shown at the left side of FIG. 1, is supported by the vertical support 40. A second electric moving motor 48 is provided on the vertical support 40. When the second electric moving motor 48 is driven, the second head 47 moves between positions above the connector holder 16 and the centering device 25 as indicated by an arrow in FIG. 1. A second slider 49, movable along the longitudinal direction of the second head 47, is provided on the side wall of the second head 47. A second electric slide motor 50 is provided in the second head 47. When the second electric drive motor 50 is driven, the second slider 49 moves along the second head 47. A second hand chuck 51 is mounted on the second slider 49. As shown in FIG. 2, a pair of hands 52, which are movable in directions toward and away from each other, are provided on the second hand chuck 51. The hands 52 are positioned at the same height as the plug connector 17, which is securely held by the connector holder 16.

A wire connector is constituted by the connector holder 16, the centering device 25, the rotated angle correcting device 35, the first head 41, the first electric moving motor 42, the first slider 43, the first electric slide motor 44, the second head 47, the second electric moving motor 48, the second slider 49, the second electric slide motor 50, and the second hand chuck 51. An inserter is constituted by the connector holder 16, the centering device 25, the rotated angle correcting device 35, the first head 41, the first electric moving motor 42, the second head 47, the second electric moving motor 48, and the second hand chuck 51. Furthermore, a position adjuster is constituted by the connector holder 16, the centering device 25, the rotated angle correcting device 35, the first slider 43, the first electric slide motor 44, the second slider 49, the second electric slide motor 50, and the second hand chuck 51.

The first hand chuck 46 will now be described specifically.

Figure 7:
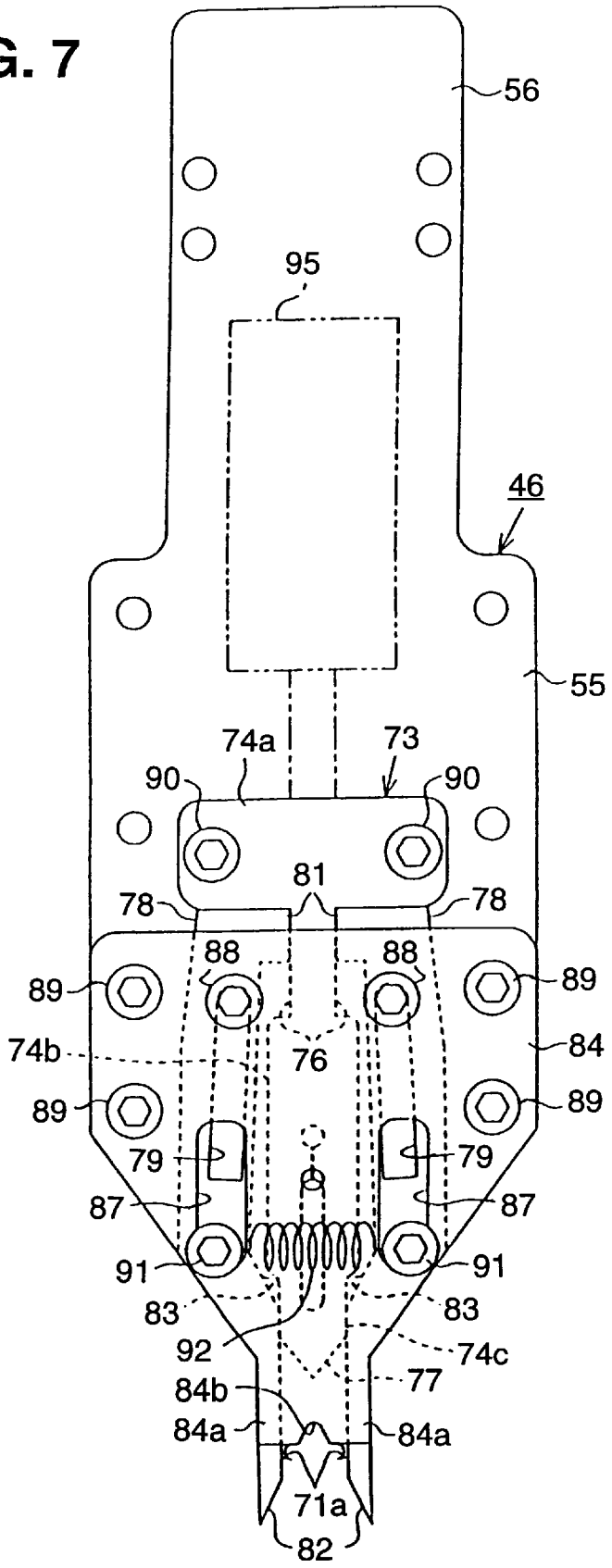
FIG. 7 is a front view showing a first hand chuck.
Figure 9:
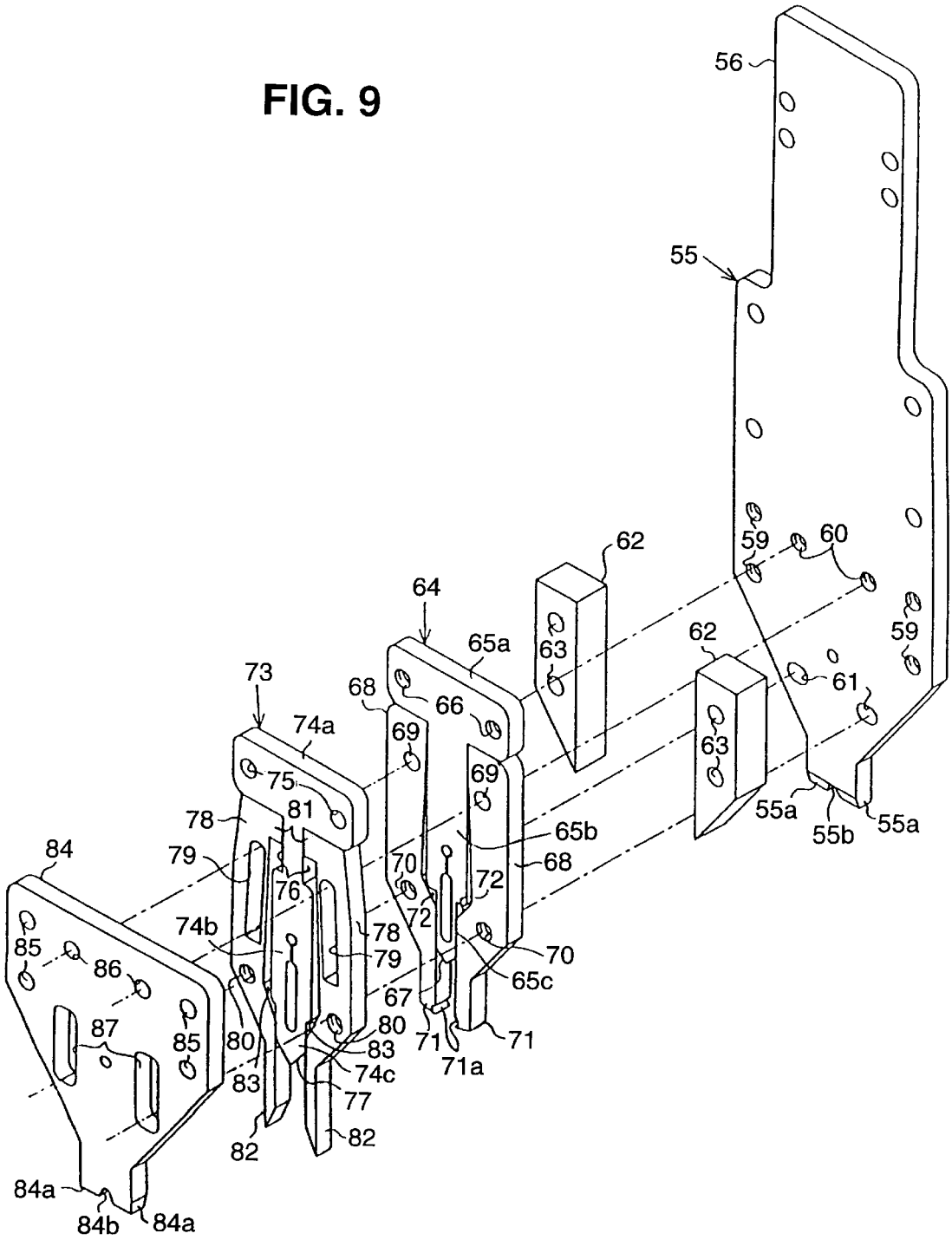
FIG. 9 is an exploded perspective view showing the first hand chuck.

As shown in FIG. 7, the first hand chuck 46 has a base plate 55. An attaching portion 56 is provided at the upper end of the base plate 55. The attaching portion 56 is attached to the lower end of the cylinder 45. As shown in FIG. 9, the distance between the sides of the base plate 55 at its bottom portion is tapered so that it becomes narrow as it approaches its bottom end. A pair of projections 55*a*, which project downward, is provided at the bottom end of the base plate 55. A stopper 55*b* is provided between the two projections 55*a*.

A pair of threaded holes 59 are formed in each side of the base plate 55. Each pair is arranged in the vertical direction. A pair of threaded holes 60 are formed between the two upper threaded holes 59 and are arranged in the horizontal direction in the base plate 55. A pair of elongated holes 61 are formed below the pair of threaded holes 60 and are arranged in the horizontal direction. The elongated holes 61 extend in the horizontal direction. A pair of guide plates 62, which extend in the vertical direction, are provided at a position corresponding to each threaded hole 59 on the front side of the base plate 55. Through holes 63 are provided on the two guide plates 62 at positions corresponding to the threaded holes 59.

A main manipulating plate 64 is provided between the two guide plates 62. The main manipulating plate 64 is constituted by a head 65*a* extending horizontally, a body 65*b* extending downward from the middle portion of the head 65*a*, and a manipulator 65*c* projecting downward from the bottom end of the body 65*b*. A threaded hole 66 is provided at each end of the head 65*a*. A tapered portion 67 is provided at the bottom of the manipulator 65*c*. The width of the tapered portion 67 becomes narrow as it proceeds downward.

Main gripping plates 68 are provided at both sides of the body 65*b*. A through hole 69 is formed at a position corresponding to the threaded hole 60 of the base plate 55, and a threaded hole 70 is formed at a position corresponding to the elongated hole 61 on each main gripping plate 68. A gripper 71 projects downward from the bottom of each main gripping plate 68. A horizontally extending rounded retaining groove 71*a* is defined on the opposing surfaces of the two grippers 71. The manipulator 65*c* of the main manipulating plate 64 is inserted between the two grippers 71. Tapered walls 72 are defined on the opposing surfaces of the two main gripping plates 68 above the grippers 71 in a manner such that the distance between the walls 72 is greater at higher locations.

A sub-manipulating plate 73 is provided at the front side of the main manipulating plate 64. The sub-manipulating plate 73 is constituted by a head 74*a*, a body 74*b*, and a manipulator 74*c* in the same manner as with the main manipulating plate 64. Through holes 75 are provided in the head 74*a* at positions corresponding to the threaded holes 66 of the main manipulating plate 64. A hooking portion 76 is defined at both sides of the upper end of the body 74*b* by cutting out both sides. A tapered portion 77 is provided at the bottom of the manipulator 74*c* in the same manner as the manipulator 65 of the main manipulating plate 64. The width of the tapered portion 77 becomes narrow as it proceeds downward.

A sub-gripping plate 78 is provided at both sides of the body 74*b*. A vertically extending slit 79 is formed in both sub-gripping plates 78. The upper end of each slit 79 is formed at a position corresponding to the through hole 69 of the corresponding gripping plate 68. A threaded hole 80 is provided on each sub-gripping plate 78 at a position corresponding to the threaded hole 70 of the corresponding main gripping plate 68. Hooking members 81 projecting toward each other are provided at the top end of the two sub-gripping plates 78. The hooking members 81 are inserted into the hooking portions 76 of the sub-manipulating plates 73.

Figure 10B:
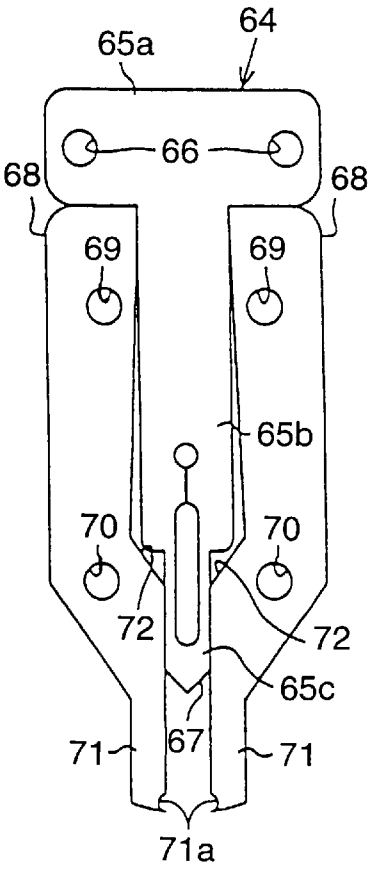
FIG. 10(*a*) is a front view showing a sub-manipulating plate and sub-gripping plates.
Figure 10A:
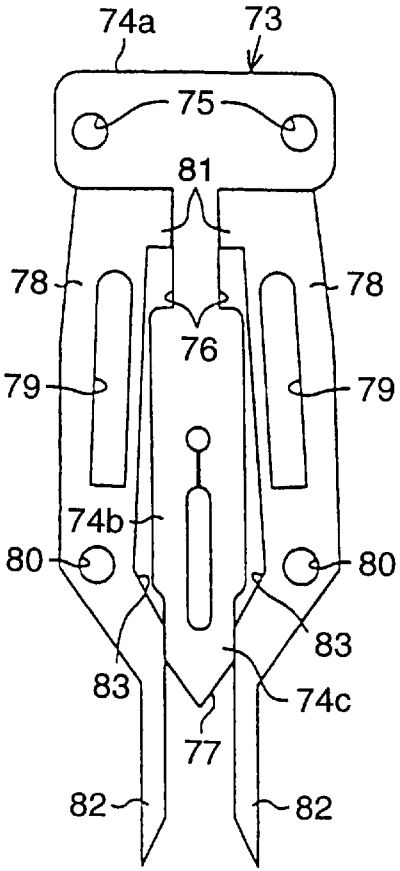

A gripper 82 projects downward from the bottom of each sub-gripping plate 78. As shown in FIGS. 10(*a*) and (*b*), the bottom end of the gripper 82 is arranged at a position lower than the bottom end of the grippers 71 of the main gripping plates 68. The distance between the opposing surfaces of the two grippers 82 widens at lower portions and thus defines a tapered shape. The manipulator 74*c* of the sub-manipulating plate 73 is inserted between the two grippers 82. The inserted length of the manipulator 74*c* between the grippers 82 is smaller than the inserted length of the manipulator 65*c* between the grippers 71. Tapered walls 83 are defined on the opposing surfaces of the two main gripping plates 78 above the grippers 81 such that the distance between the walls 83 widens at higher portions.

Figure 11B:
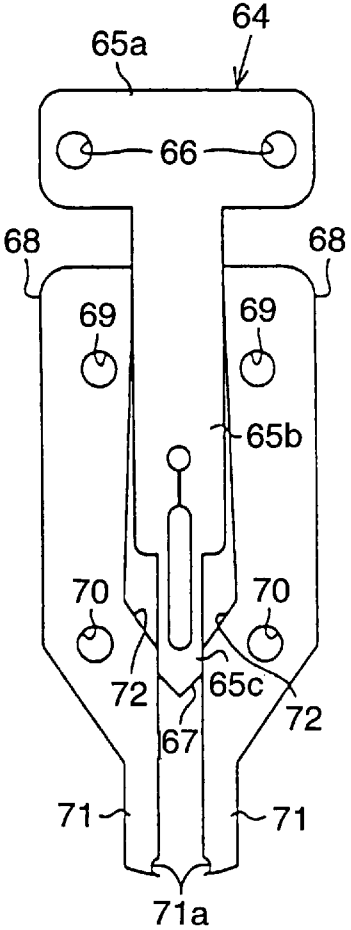
FIG. 11(*a*) is a front view showing a sub-manipulating plate and sub-gripping plates.
Figure 11A:
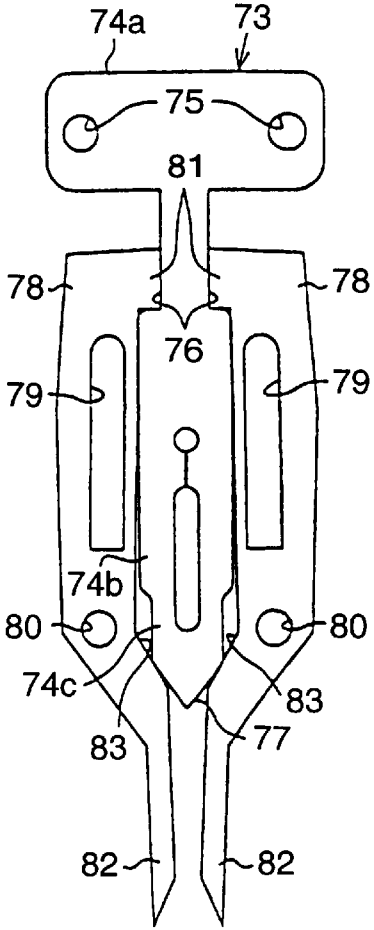

As shown in FIG. 11(*a*), when the sub-manipulating plate 73 is pulled upward, the bottom of the hooking members 81 on both sub-gripping plates 78 are hooked to the bottom of the hooking portions 76 of the sub-manipulating plate 73. In this state, the bottom of the tapered wall 83 of each sub-gripping plate 78 abuts against the tapered portion 77 of the sub-manipulating plate 73. This minimizes the distance between the two grippers 82. The length of the hooking portion 76 is sized to allow abutment between the bottom of the tapered walls 83 and the tapered portion 77 when the bottom of the hooking members 81 are hooked to the bottom of the hooking portion 76.

As shown in FIG. 9, an auxiliary plate 84 is provided in front of the sub-manipulating plate 73. The auxiliary plate 84 has substantially the same shape as the bottom portion of the base plate 55. In the same manner as the base plate 55, projections 84*a* and a stopper 84*b* are provided at the bottom of the auxiliary plate 84. Through holes 85 are provided at positions corresponding to the through holes 63 of the guide plates 62. Through holes 86 are provided at positions corresponding to the top portion of the slits 79. Elongated communicating holes 87 are provided at positions corresponding to the threaded holes 80 of the sub-gripping plates 78 such that the opening of each communicating hole 87 encompasses the associated threaded hole 80. The communicating holes 87 extend vertically. The communicating holes 87 are wider than the diameter of the threaded holes 80.

As shown in FIG. 7, bolts 88 are screwed into the threaded holes 60 of the base plate 55 via the through holes 86 of the auxiliary plate 84, the slits 79 of the two sub-gripping plates 78, and the through holes 69 of the two main gripping plates 68. The sub-gripping plates 78 and the main gripping plates 68 are pivotal about the bolts 88. As shown in FIG. 7, bolts 89 are screwed into the threaded holes 59 of the base plate 55 via the through holes 85 of the auxiliary plate 84 and the through holes 63 of the two guide plates 62. Bolts 90 are screwed into the threaded holes 66 of the main manipulating plate 64 via the through holes 75 of the sub-manipulating plate 73. The bolts 90 couple the sub-manipulating plate 73 to the main manipulating plate 64.

Figure 8:
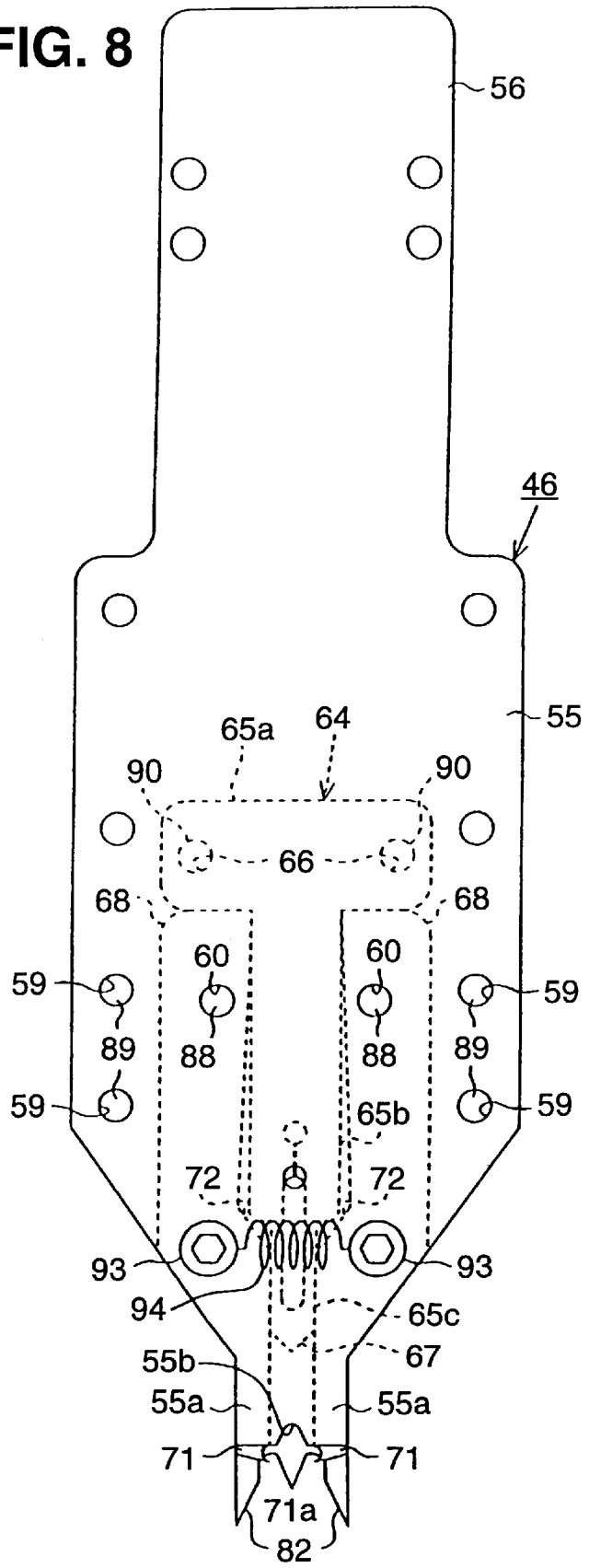
FIG. 8 is a rear view showing the first hand chuck.

As shown in FIG. 7, a pair of bolts 91 are screwed into the threaded holes 80 of the two sub-gripping plates 78 via the communicating holes 87 of the auxiliary plates 84. A coil spring 92 located between the two bolts 91 connects the bolts 91. The two sub-gripping plates 78 are constantly urged toward each other by the coil spring 92. As shown in FIG. 8, a pair of bolts 93 are screwed into the threaded holes 70 of the two main gripping plates 68 via the elongated holes 61 of the base plate 55. A coil spring 94 located between the two bolts 93 connects the bolts 93. The two main manipulating plates 68 are constantly urged toward each other by the coil spring 94.

As shown in FIG. 7, an air cylinder 95 extendible in the vertical direction is provided at the upper front side of the base plate 55. The bottom of the air cylinder 95 is connected to the head 65*a* of the main manipulating plate 64 and the head 74*a* of the sub-manipulating plate 73.

Operation of the above processed wire connecting apparatus 11 will now be described.

The first head 41 is moved by the first electric moving motor 42 to a position above the storage cases 14*a*–14*h*, i.e., the position marked as A and shown by a solid line in FIG. 1. The first slider 43 is moved by the first electric slide motor 44 to a position above the storage case 14*a*, i.e., the position marked as B and shown by the solid line in FIG. 2. The first hand chuck 46 is moved downward into the storage case 14*a* by the extension of the cylinder 45. This enables a plurality of processed wires 15 inside the storage case 14*a* to be inserted between the grippers 71 of the two main gripping plates 68 and between the grippers 82 of the two sub-gripping plates 78, shown in FIGS. 10(*a*) and (*b*), of the first hand chuck 46.

In this state, the main manipulating plate 64 and the sub-manipulating plate 73 are moved upward by the retraction of the air cylinder 95 to positions shown in FIGS. 11(*a*) and (*b*). This hooks the bottom of the hooking members 81 of the two sub-gripping plates 78 to the bottom of the two hooking portions 76 of the sub-manipulating plate 73. The manipulator 65*c* of the main manipulating plate 64 and the manipulator 74*c* of the sub-manipulating plate 73 are further moved upward. This brings the tapered portion 77 of the manipulator 74*c* of the sub-manipulating plate 73 to a position corresponding to the bottom of the tapered walls 83 of the two sub-gripping plates 78. This pivots the two sub-gripping plates 78 toward each other with the bolts 88 functioning as a fulcrum due to the elastic force of the coil spring 92. As a result, the grippers 82 of two sub-gripping plates 78 are moved toward each other to grip the plurality of processed wires 15.

Figure 12B:
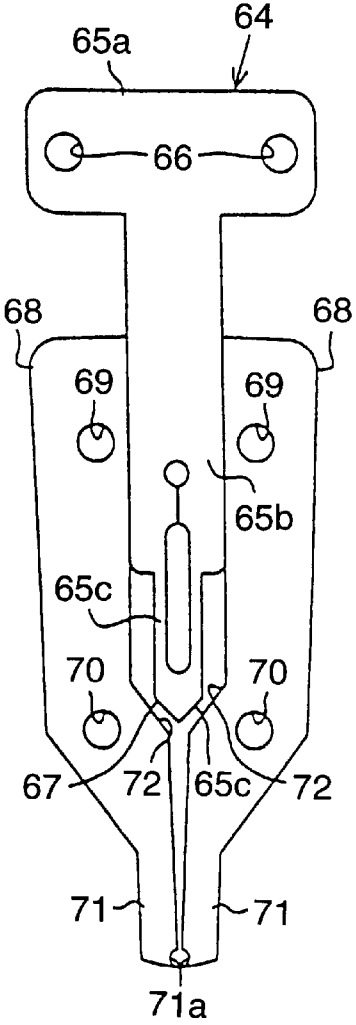
FIG. 12(*a*) is a front view showing a sub-manipulating plate and sub-gripping plates.
Figure 12A:
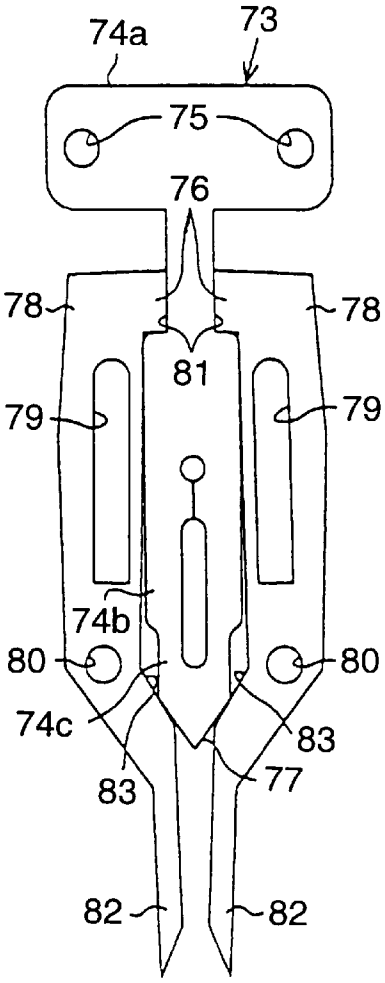

After the grippers 82 grip the plurality of processed wires 15, the main manipulating plate 64 and the sub-manipulating plate 73 are further moved upward. This moves the two sub-gripping plates 78 hooked to the sub-manipulating plate 64 upward, as shown in FIG. 12(*a*). This movement lifts the plurality of processed wires 15 gripped by the grippers 82 while the tapered portion 67 of the manipulator 65*c* of the main manipulating plate 64 is removed upward from between the grippers 71 of the main gripping plates 68. The lifted processed wires 15 come into contact with the stopper 55*b* of the base plate 55 and the stopper 84*b* of the auxiliary plate 84. This allows the processed wires 15 to be retained at the same position while sliding against the grippers 82 as the grippers 82 move upward. In this state, the processed wires 15 are located at a position corresponding to the retaining groove 71*a* of the gripper 71 of the two main gripping plates 68.

When the tapered portion 67 is removed upward from between the grippers 71, the two main gripping plates 68 are pivoted toward each other by the elastic force of the coil spring 94 with the bolts 88 each acting as a fulcrum. The grippers 71 of the two holding pieces 68 moving toward each other results in one processed wire 15, which is the wire that comes into contact with the stoppers 55*b*, 84*b* among the plurality of wires 15 held between both grippers 82 of the sub-gripping plates 78, being gripped between the retaining grooves 71*a* provided on both grippers 71. The remaining processed wires 15, which were not gripped between the retaining grooves 71*a* of the two grippers 71, fall into the storage case 14*a* from between the grippers 82 of the sub-gripping plates 78. Consequently, only one processed wire 15 is gripped between the two grippers 71.

The first hand chuck 46, which has gripped one piece of processed wire 15, is moved upward by the retraction of the cylinder 45. The first head 41 and the first slider 43 are then moved to positions C and D, respectively, shown in the double-dotted lines of FIG. 2, by the drive of the first electric moving motor 42 and the first electric sliding motor 44, respectively. When the first head 41 reaches position C and the first slider 43 reaches position D, the first hand chuck 46 is located above the centering device 25.

The first hand chuck 46 is moved downward for a predetermined distance by the extension of the cylinder 45. As shown in FIG. 4, this locates the processed wire 15, gripped by the first hand chuck 46, between the clamping pieces 31, 32 and inserts it between the clamping plates 36, 37 of the rotated angle correcting device 35. In this state, the main manipulating plate 64 and the sub-manipulating plate 73 are moved downward by the extension of the air cylinder 45 of the first hand chuck 46. This causes the manipulator 65*c* of the main manipulating plate 64 and the manipulator 74*c* of the sub-manipulating plate 73 to be inserted between the grippers 71 of the two main gripping plates 68 and the grippers 82 of the two sub-gripping plates 78, respectively. As a result, the two main gripping plates 68 and the two sub-gripping plates 78 are pivoted away from each other with the bolts 88 acting as a fulcrum. The pivoting of the main gripping plates 68 and the sub-gripping plates 78 moves the grippers 71 of the main gripping plates 68 and the grippers 82 of the sub-gripping plates 78 away from each other against the elastic force of the coil springs 92, 94, respectively, and releases the processed wire 15.

The first hand chuck 46, which has released the processed wire 15, is moved upward by the cylinder 45 while the first head 41 and the first slider 43 are moved to a position above the storage case 14*b*.

The processed wire 15 is held between the middle portion of the clamping pieces 31, 32, as shown in FIG. 5, when the clamping pieces 31, 32, which have received the processed wire 15, are pivoted toward each other about the support shaft 28. The processed wire 15 is held between the clamping pieces 31, 32 such that it is aligned in the same direction as the axes of one of the connecting holes 18*a*–18*h* of the plug connector 17, which is held by the connector holder 16.

Figure 6:
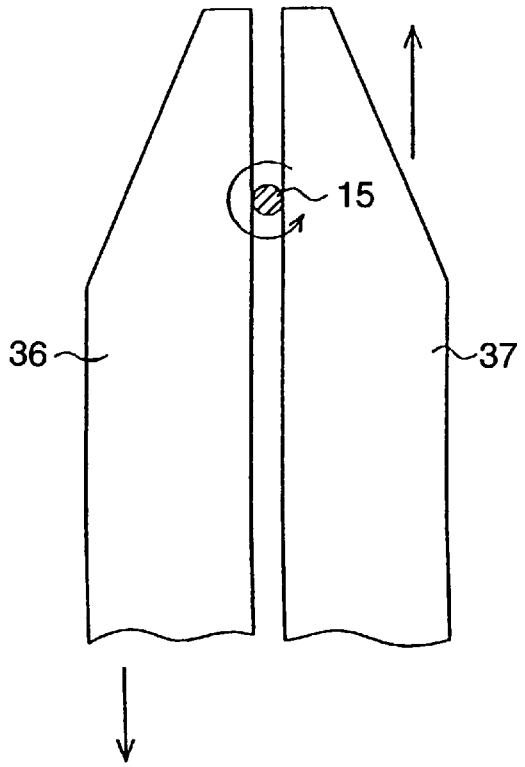
FIG. 6 is a partial front view showing the clamping plates.

Afterwards, the electric advancing motor 27 is driven to horizontally move the moving member 26 away from or toward the centering device 25. This moves the terminal 22 of the processed wire 15, held between the clamping pieces 31, 32, to a position corresponding to the rotated angle detecting sensor 25*a*. The electric rotating motor 39 is then driven to move the clamping plates 36, 37, which hold the processed wire 15, in opposite parrallel directions, as shown in FIG. 6. The processed wire 15, held between the clamping plates 36, 37, is thus rotated about its axis without being displaced. The terminal 22 of the processed wire 15 is rotated together with the processed wire 15.

The rotated angle detecting sensor 25*a* detects the angle where the terminal 22 is rotated to about the axis of the processed wire 15 and transmits a detected signal according to the rotated angle of the terminal 22. The electric rotating motor 39 is driven based on the detected signal sent by the rotated angle detecting sensor 25*a*. The electric rotating motor 39 rotates the processed wire 15 to the position shown in FIG. 3 where the fastening plates 24 of the terminal 22 projects toward the opposite sides of the plane of FIG. 3. This enables insertion of the terminal 22 of the processed wire 15 into the connecting holes 18*a*–18*h* of the plug connector 17, as shown in the state of FIG. 3.

The second hand chuck 51 is then moved to a position corresponding to the centering device 25 by the second electric drive motor 50. The second head 47 is moved toward the centering device 25 to a position E shown in the double dotted line of FIG. 1 by the second electric moving motor 48. When the second head 47 reaches position E, the terminal 22 side of the processed wire 15 is inserted between the two hands 52 of the second hand chuck 51. Both hands 52 of the second hand chuck 51 are then moved toward each other to grip the terminal 22 side of the processed wire 15.

When both hands 52 grip the processed wire 15, the clamping pieces 31, 32, which hold the wire 15 therebetween, are pivoted away from each other about the support shaft 28. The second head 47 is then moved to a position F, shown in the solid line of FIG. 1, by the second electric moving motor 50. During the movement of the second head 47, the second slider 49 is moved by the second electric slide motor 50. This causes the axis of the processed wire 15, held by the second hand chuck 51, to be aligned with the axis of the connecting hole 18*a* of the plug connector 17, as shown in FIG. 3, before the second head 47 reaches position F.

When the second head 47 reaches position F, the terminal 22 of the processed wire 15 held by the second hand chuck 51 is inserted into the connecting hole 18*a* of the plug connector 17. This inserts the projection 19 provided inside the connecting hole 18*a* into the space between the parallel portions 24*a* of the fastening plates 24. The fastening portions 24*b* of the two fastening plates 24 are hooked to the securing grooves 21 inside the connecting holes 18*a* by their own elastic force. Consequently, the processed wire 15 is connected to the plug connector 17 so that the wire 15 does not fall out from the connecting hole 18*a*. After the processed wire 15 is connected to the plug connector 17, the hands 52 of the hand chuck 51 are moved away from each other to release the processed wire 15.

The processed wires 15 inside the storage cases 14*b*–14*h* are inserted into the associated connecting holes 18*b*–18*h* of the plug connector 17 one after another to connect the differently colored processed wires 15 to the connector 17. Connection of the processed wires 15 to the plug connector is completed when the wires 15 of each storage case 14*a*–14*h* are connected to the connector 17.

As described above, the processed wire connecting apparatus 11 of the present embodiment is provided with a first hand chuck 46 to grip the processed wires 15, which were cut into lengths of about 20 cm. The processed wires 15 taken out from the storage cases 14*a*–14*h* by the first hand chuck 46 are connected to the connector 17. Therefore, since it is not necessary to store wires in a wound state, it is possible to simplify the structure of the connecting apparatus 11.

The first hand chuck 46 takes out differently colored processed wires 15 from the storage cases 14*a*–14*h* one after another. Therefore, a mechanism such as that used in the prior art that slides a plurality of wire feeding devices is not required to connect the differently colored wires 15 to the plug connector 17. Thus, it is possible to further simplify the structure of the connecting apparatus 11.

The processed wire 15 held by the first and second hand chucks 46, 51 is moved toward the plug connector 17, which is secured to the connector holder 16, by the movement of the first and second heads 41, 47. Accordingly, it is possible to securely insert the terminals 22 of the processed wires 15 into the connecting holes 18*a*–18*h* of the plug connector 17.

The processed wire 15 held by the second hand chuck 51 is aligned at a position corresponding to each connecting hole 18*a*–18*h* of the plug connector 17. This aligns the axis of the processed wire 15 with the axes of the connecting holes 18*a*–18*h*. Hence, it is possible to precisely insert differently colored processed wires 15 into each connecting hole 18*a*–18*h*.

With the first hand chuck 46 of the present embodiment, the two sub-gripping plates 78 first hold a plurality of processed wires 15. The two main gripping plates 68 then grip one processed wire 15, extracted from the plurality of wires 15, between both retaining grooves 71*a*. Thus, it is possible to extract one processed wire from the storage cases 14*a*–14*h*, which accommodate a plurality of processed wires 15, and connect the wire 15 to the plug connector 17.

With the processed wire connecting apparatus 11, the processed wire 15 held between the clamping pieces 31, 32 of the centering device 25 is rotated about its axis by the rotated angle correcting device 35. The rotation of the processed wire 15 enables the terminal 22 to be positioned at a rotated angle where it can be inserted into the connecting holes 18*a*–18*h* of the plug connector 17. Therefore, it is possible to precisely insert the terminal 22 into the connecting holes 18*a*–18*b* of the plug connector 17 and securely connect the wire 15 to the plug connector 17.

The processed wire 15 held between the clamping pieces 31, 32 is held between the clamping plates 36, 37 of the rotated angle correcting device 35. Since the movement of the clamping plates 36, 37 in opposite vertical directions rotates the processed wire 15 about its axis, it is possible to easily and securely rotate the processed wire 15 about its axis.

Furthermore, the rotated angle detecting sensor 25*a* detects the rotated angle of the terminal 22, which is rotated about the axis of the processed wire 15 by the clamping plates 36, 37, and transmits a detected signal, which corresponds to the rotated angle position of the terminal 22. The electric drive motor 39 that moves the clamping plates 36, 37 in opposite directions is driven based on the detected signal transmitted from the rotated angle detecting sensor 25*a*. Since the terminal 22 is rotated by the electric drive motor 39, positioning of the terminal 22 at a rotating position enabling insertion into the connecting holes 18*a*–18*h* is ensured.

The present invention may be modified into forms such as those described below.

The connector holder 16 may be movable in a direction perpendicular to the plane of FIG. 1. The axis of the processed wire 15 gripped by the second hand chuck 51 and the axis of the connecting holes 18*a*–18*h* in the plug connector 17 may be aligned with each other by moving the connector holder 16 or the second slider 49 in a direction perpendicular to the plane of FIG. 1. In this case, if both the connector holder 16 and the second slider 49 are moved, it is possible to further shorten the time necessary to align the axis of the processed wires 15, gripped by the second hand chuck 51, with the axes of the connecting holes 18–18*h* in the plug connector 17.

The connector holder 16 may be movable in the same directions as the first and second heads 41, 47. The processed wire 15 gripped by the second hand chuck 51 may be connected to the plug connector 17 by moving at least one among the connector holder 16 and the second head 47 toward the other. In this case, if both the connector holder 16 and the second head 47 are moved toward each other, it is possible to further shorten the time necessary to connect the processed wire 15 gripped by the second hand chuck 51 to the plug connector 17.

In the above processed wire connecting apparatus 11, the second head 47, the second electric moving motor 48, the second slider 49, the second electric sliding motor 50, and the second hand chuck 51 may be omitted. The connector holder 16 may be moved along a direction perpendicular to the plane of FIG. 1 to align the axis of the processed wire 15, held by the centering device 25 and the rotated angle correcting device 35, with the axes of the connecting holes 18*a*–18*h* in the plug connector 17. Furthermore, the connector holder 16 may be moved toward the devices 25, 35 to connect the processed wire 15 held by the devices 25, 35 to the plug connector 17. This further simplifies the structure of the processed wire connecting apparatus 11.

In the above processed wire connecting apparatus 11, the centering device 25 and the rotated angle correcting device 35 may further be omitted if the terminals 22 may be inserted into the connecting holes 18*a*–18*h* at any angular position of the terminals 22 about their longitudinal axes. In this case, the first head 41 is provided such that it may be moved to a position in the vicinity of the connector holder 16. Furthermore, the first hand chuck 46 is constituted in a manner that a processed wire 15 gripped by the first hand chuck 46 may be aligned with the connecting holes 18*a*–18*h* in the plug connector 17. At least one among the connector holder 16 and the first slider 43 may be moved along a direction perpendicular to the plane of FIG. 1 to align the axis of the processed wire 15 held by the first chuck 46 with the axes of the connecting holes 18*a*–18*h* in the plug connector 17. In addition, at least one among the connector holder 16 and the first head 41 may be moved toward the other to connect the processed wire 15, gripped by the first hand chuck 46, to the plug connector 17. When constituted in this manner, it is possible to simplify the structure of the processed wire connecting apparatus 11.

The centering device 15 and the rotated angle correcting device 35 may be omitted if the terminals 22 are of a type that can be inserted into the connecting holes 18*a*–18*h* at any angular position about their longitudinal axes. Furthermore, the first head 41 is fixed to a position above the storage cases 14*a*–14*h*, and the second head 47 is provided such that it may be moved to a position in the vicinity of the first head 41. The processed wire 15 gripped by the first hand chuck 46 is then gripped by the second hand chuck 51. By moving the second slider 49, the axis of the processed wire gripped by the second hand chuck 51 is aligned with the axes of the connecting holes 18*a*–18*h* in the plug connector 17. The second head 47 may be moved toward the connector holder 16 to connect the processed wire 15, gripped by the second hand chuck 51, to the plug connector 17. It is possible to simplify the structure of the processed wire connecting apparatus 11 by constituting it in this manner.

The centering device 25 and the rotating position compensation device 35 may be provided such that they are movable in a direction perpendicular to the plane of FIG. 1. In this case, both devices 25, 35 are moved in a direction perpendicular to the plane of FIG. 1 to align the axis of the processed wire 15, gripped by the two devices 25, 35, and the axes of the connecting holes 18*a*–18*h*. It is possible to obtain the same effects as the first embodiment with this structure.

The centering device 25 and the rotated angle correcting device 35 may be provided such that they are movable in the same direction as the first and second heads 41, 47. At least one among the devices 25, 35 and the first head 41 may be moved toward the other to hold the processed wire 15, which is held by the first hand chuck 46, with the devices 25, 35. In addition, at least one among the devices 25, 35 and the second head 47 may be moved toward the other to hold the processed wire 15, which is held by the devices 25, 35, with the second hand chuck 51. It is possible to obtain the same effects as the first embodiment with this structure.

In the above processed wire connecting apparatus 11, the second head 47, the second electric moving motor 48, the second slider 49, the second electric slide motor 50, and the second hand chuck 51 may be omitted. In this case, the centering device 25 and the rotated angle correcting device 35 are moved toward the connector holder 16 to connect the processed wire 15, held by the devices 25, 35, to the plug connector 17. This simplifies the processed wire connecting device 11.

The connector holder 16 may be omitted and the plug connector 17 may be securely held by the second hand chuck 51. In this case, the second slider 49 is moved to align the axes of the connecting holes 18*a*–18*h* in the plug connector 17 with the axis of the processed wire 15, gripped by the second hand chuck 51. The second head 47 is further moved toward the two devices 25,35 to connect the processed wire 15 to the plug connector 17, gripped by the second hand chuck. It is possible to further simplify the structure of the processed wire connecting apparatus 11 by constituting it in this manner.

The plug connector 17 may be provided with only one connecting hole, e.g., only the connecting hole 18*a*. In this case, since only one processed wire 15 is inserted into the connecting hole 18*a*, it is possible to omit the plurality of storage cases 14*a*–14*h* and simplify the structure of the connecting apparatus 11. Furthermore, if the plug connector 17, the centering device 25, the rotated angle correcting device 35, and the storage case 14*a* are provided along the same plane, it is not necessary to move the first and second sliders 43, 49. Accordingly, this will allow the first and second sliders 43, 49 and the first and second electric slide motors 44, 50 to be omitted. Hence, this will simplify the processed wire connecting apparatus 11.

If the processed wire connecting apparatus 11 is constituted such that a plurality of processed wires 15 may simultaneously be connected to the plug connector 17, the first hand chuck 46 may be constituted to grip the plurality of wires 15.

The processed wire 15 is preferably rotated about its axis by moving the clamping plates 36, 37, which hold the processed wire therebetween, in opposite vertical directions. However, the rotated angle correcting device may be constituted in a manner different from the above embodiment if it is possible to rotate the processed wire 15 about its axis.

The length of the processed wires 15 is preferably 20 cm. However, the length may be changed to an appropriate size.

Furthermore, attachment of the terminal 22 to the processed wire 15 may be omitted. In this case, the end portion of the processed wire 15 is inserted into the connecting holes 18*a*–18*h*.

The processed wires 15 have been described as being connected to the plug connector 17. However, the processed wire 15 may be connected to a socket connector, which serves as a wire connecting body.

We claim:

1. An apparatus for automatically connecting processed wires to a connector body having holes for receiving wires, the apparatus comprising:

a wire gripper including a pair of first gripping plates and a pair of second gripping plates for selectively lifting a processed wire, which is cut to a predetermined length, from a pile of processed wires, wherein the first gripping plates and the second gripping plates cooperate to grip and separate one processed wire from the pile of the processed wires and to lift the separated processed wire from the pile of processed wires;

a wire inserting means for inserting the lifted processed wire into one of the holes on the connector body by moving the lifted processed wire relative to the connector body; and correcting means for changing the orientation of an undesirably oriented lifted processed wire to a desired orientation such that an axis of the lifted processed wire is aligned with an axis of one of the holes, wherein each of the processed wires includes a terminal affixed to at least one end, and wherein the correcting means includes a rotator for rotating the lifted processed wire about the longitudinal axis of the lifted processed wire to orient the terminal to a predetermined orientation prior to insertion in the connector body, wherein the rotator includes a pair of clamping plates for engaging the lifted processed wire, wherein the clamping plates are constructed and arranged to move in opposite but parallel directions.

2. A wire connecting apparatus according to claim 1, wherein the wire inserting means moves the lifted processed wire relative to the connector body along an axis of the lifted processed wire to insert the lifted processed wire into the connector body.

3. A wire connecting apparatus according to claim 1 including a detector for detecting the orientation of the terminal, wherein the rotator rotates the lifted processed wire about its axis in accordance with a signal from the detector.

4. An apparatus for automatically connecting processed wires to a connector body having holes for receiving wires, the apparatus comprising:

a wire gripper including a pair of first gripping plates and a pair of second gripping plates for selectively lifting a processed wire, which is cut to a predetermined length, from a pile of processed wires, wherein the first gripping plates and the second gripping plates cooperate to grip and separate one processed wire from the pile of the processed wires and to lift the separated processed wire from the pile of processed wires;

a wire inserting means for inserting the lifted processed wire into one of the holes on the connector body by moving the lifted processed wire relative to the connector body; and a manipulating mechanism, wherein the second gripping plates initially grip the plurality of wires from the pile, and then the first gripping plates select one wire from the plurality of wires by manipulation of the manipulating mechanism.

5. An apparatus for automatically connecting processed wires to a connector body having holes for receiving wires, the apparatus comprising:

a storage device for holding a pile of processed wires, which are cut to a predetermined length;

a wire gripper including a pair of main gripping members and a pair of sub-gripping members for selectively lifting a processed wire from the pile of the processed wires, wherein the main gripping members and the sub-gripping members cooperate to initially grip several wires from the pile of the processed wires, and wherein the main gripping members and the sub-gripping members further cooperate to separate and lift one processed wire from the gripped wires; and a wire inserting means for inserting the lifted processed wire into one of the holes on the connector body by moving the lifted processed wire relative to the connector body.

6. A wire connecting apparatus according to claim 5, including correcting means for changing the orientation of an undesirably oriented wire to a desired orientation such that an axis of the lifted processed wire is aligned with an axis of one of the holes.

7. A wire connecting apparatus according to claim 6, wherein each of the processed wires includes a terminal affixed to at least one end, and wherein the correcting means includes a rotator for rotating the lifted processed wire about its axis to orient the terminal to a predetermined orientation prior to insertion in the connector body.

8. A wire connecting apparatus according to claim 7, wherein the rotator includes a pair of clamping plates for engaging the lifted processed wire arranged to move in opposite but parallel directions.

9. A wire connecting apparatus according to claim 7 including a detector for detecting the orientation of the terminal, wherein the rotator rotates the lifted processed wire about its axis in accordance with a signal from the detector.

10. A wire connecting means according to claim 5 including a manipulating mechanism, wherein the sub-gripping members initially grip a group of wires from the pile, and then the main gripping members select one wire from the group by manipulation of the manipulating mechanism.

11. A method for automatically connecting processed wires to a connector body having holes for receiving wires, the method comprising:

gripping several processed wires from a pile of the processed wires, wherein the processed wires are cut to a predetermined length;

separating one processed wire from the gripped wires by cooperation of a pair of first gripping members of a wire gripper and a pair of second gripping members of the wire gripper; and inserting the separated wire into one of the holes on the connector body by moving the separated wire relative to the connector body.

12. A method according to claim 11, including moving the lifted processed wire relative to the connector body along an axis of the lifted processed wire to insert the wire into the connector body.

13. A method according to claim 11, including changing the orientation of an undesirably oriented wire to a desired orientation such that the axis of the lifted processed wire is aligned with an axis of one of the holes.

14. A method according to claim 13, wherein the processed wires include a terminal affixed to at least one end, and wherein the correcting means rotates the lifted processed wire with a rotator about its axis to orient the terminal to a predetermined orientation prior to insertion in the connector body.

15. A method according to claim 14, wherein the rotator includes a pair of clamping plates for engaging the lifted processed wire, and wherein the method includes the step of moving the plates in opposite but parallel directions to rotate the wire about its axis.

16. A method according to claim 14, wherein a detector for detecting the orientation of the terminal issues a signal, and wherein the rotator rotates the lifted processed wire about its axis in accordance with the signal.

17. The method according to claim 11 further comprising:

lifting the selected processed wire from the pile of processed wires; and inserting the lifted wire into one of the holes on the connector body by moving the lifted wire relative to the connector body.

18. An apparatus for automatically connecting processed wires to a connector body having holes for receiving wires, the apparatus comprising:

a wire gripper including a pair of first gripping plates and a pair of second gripping plates for lifting a processed wire, which is cut to a predetermined length, from a pile of such wires, wherein the first gripping plates and the second gripping plates cooperate to separate and lift the processed wire from of a plurality of wires;

a wire inserting means for inserting the lifted processed wire into one of the holes on the connector body by moving the lifted processed wire relative to the connector body;

a correcting means for changing the orientation of an undesirably oriented lifted processed wire to a desired orientation such that an axis of the lifted processed wire is aligned with an axis of one of the holes;

wherein each of the processed wires includes a terminal affixed to at least one end, and wherein the correcting means includes a rotator for rotating the lifted wire about a longitudinal axis of the lifted processed wire to orient the terminal to a predetermined orientation prior to insertion in the connector body; and wherein the rotator includes a pair of clamping plates for engaging the lifted processed wire, wherein the clamping plates are constructed and arranged to move in opposite but parallel directions.

19. An apparatus for automatically connecting processed wires to a connector body having holes for receiving wires, the apparatus comprising:

a wire gripper including a pair of first gripping plates and a pair of second gripping plates for lifting a processed wire, which is cut to a predetermined length, from a pile of such wires, wherein the first gripping plates and the second gripping plates cooperate to separate and lift the processed wire from of a plurality of wires;

a wire inserting means for inserting the lifted processed wire into one of the holes on the connector body by moving the lifted processed wire relative to the connector body; and a manipulating mechanism, wherein the second gripping plates initially grip the plurality of processed wires from the pile, and then the first gripping plates select one wire from the plurality of wires by manipulation of the manipulating mechanism.

20. An apparatus for automatically connecting processed wires to a connector body having holes for receiving wires, the apparatus comprising:

a storage device for holding a pile of processed wires, which are cut to a predetermined length;

a wire gripper including a pair of main gripping members and a pair of sub-gripping members for lifting a processed wire from the pile, wherein the main gripping members and the sub-gripping members cooperate to separate the lifted processed wire from the pile;

a wire inserting means for inserting the lifted processed wire into one of the holes on the connector body by moving the lifted processed wire relative to the connector body; and a manipulating mechanism, wherein the sub-gripping members initially grip a group of wires from the pile, and then the main gripping members select one wire from the group by manipulation of the manipulating mechanism.

21. A method for automatically connecting processed wires to a connector body having holes for receiving wires, the method comprising:

actuating a pair of first gripping members of a wire gripper and actuating a pair of second gripping members of the wire gripper for lifting a processed wire, which is cut to a predetermined length, from a pile of such wires;

separating a single wire from a group of wires by cooperation of the first gripping members and the second gripping members;

actuating a wire inserting means for inserting the lifted processed wire into one of the holes on the connector body by moving the lifted processed wire relative to the connector body;

changing the orientation of an undesirably oriented wire with correcting means to a desired orientation such that an axis of the lifted processed wire is aligned with an axis of one of the holes, wherein the processed wires include a terminal affixed to at least one end, and wherein the correcting means rotates the lifted processed wire with a rotator about its axis to orient the terminal to a predetermined orientation prior to insertion in the connector body; and wherein the rotator includes a pair of clamping plates for engaging the lifted processed wire, and wherein the method includes the step of moving the plates in opposite but parallel directions to rotate the wire about its axis.

22. A method for automatically connecting processed wires to a connector body having holes for receiving wires, the method comprising:

actuating a pair of first gripping members of a wire gripper and actuating a pair of second gripping members of the wire gripper for lifting a processed wire, which is cut to a predetermined length, from a pile of such wires;

separating a single wire from a group of wires by cooperation of the first gripping members and the second gripping members; and actuating a wire inserting means for inserting the lifted processed wire into one of the holes on the connector body by moving the lifted processed wire relative to the connector body, wherein the second gripping plates initially grip the group of wires from the pile and then the first gripping plates separate one wire from the group by manipulation of a manipulating mechanism.

* * * * *